United States Patent [19]

Scholz

[11] Patent Number: 4,909,746

[45] Date of Patent: Mar. 20, 1990

[54] CONTACT FOR STACKABLE ELECTRICAL CONNECTOR

[75] Inventor: James P. Scholz, New Cumberland, Pa.

[73] Assignee: AMP Incorporated, Harrisburgh, Pa.

[21] Appl. No.: 359,443

[22] Filed: May 31, 1989

[51] Int. Cl.[4] ..... H01R 9/09

[52] U.S. Cl. ..... 439/82; 439/74; 439/886; 439/751

[58] Field of Search ..... 439/74, 81–83, 439/751, 876–879, 886

[56] References Cited

U.S. PATENT DOCUMENTS

| | | | |
|---|---|---|---|
| 3,404,367 | 10/1968 | Henschen | 339/217 |
| 3,545,080 | 12/1970 | Evans | 29/629 |
| 3,812,452 | 5/1974 | Sturm | 439/886 |
| 3,818,415 | 6/1974 | Evans et al. | 439/886 |
| 3,927,841 | 12/1975 | Iacobucci | 439/886 |
| 4,133,592 | 1/1979 | Cobaugh et al. | 439/74 |
| 4,206,964 | 6/1980 | Olsson | 339/221 M |
| 4,769,907 | 9/1988 | Sebastien | 439/82 |
| 4,797,113 | 1/1989 | Lambert | 439/74 |
| 4,828,514 | 5/1989 | Johnson et al. | 439/751 |

OTHER PUBLICATIONS

AMP Customer Drawing No. 532466, "Snap-In Box Contact, Double Latch", (1984); AMP Incorporated, Harrisburg, PA.

AMP Customer Drawing No. 533650, "Receptacle Connector With 0.250 Long Action Pin Post, 2-Row", Sheets 1 and 2, (1986 Rev. 2-89); AMP Incorporated, Harrisburg, Pa.

AMP Drawing No. 533667, "Contact Assembly, Action Pin Post for Receptacle Connector with 0.250 Long Tail (LH)", (1985 Rev 2-89); AMP Incorporated, Harrisburg, Pa.

*Primary Examiner*—P. Austin Bradley

*Attorney, Agent, or Firm*—Anton P. Ness

[57] ABSTRACT

An electrical contact of the type having a square post contact section at one end and a box-like receptacle contact section at the other end matable with such a post section of a like contact, for use in stackable connectors for interconnecting printed circuit boards of a parallel array, is formed to have a square post with flat side surfaces with an originally square cross-section of dimensions matable with the box-like receptacle contact section, but the contact is modified by having the corners of the square post section smoothly rounded. The diagonal of the cross-section is thereby substantially reduced and is insertable through a through-hole of the board which has a diameter similarly substantially smaller than the diagonal of the original square cross-section, while the post section maintains side surfaces which remain substantially flat for mating with an unmodified box-like receptacle contact section. The contact maintains at least the mating characteristics of a contact having the original square cross-section post section, while a smaller array of through-holes for board interconnection is possible because the hole diameters are reduced.

4 Claims, 6 Drawing Sheets

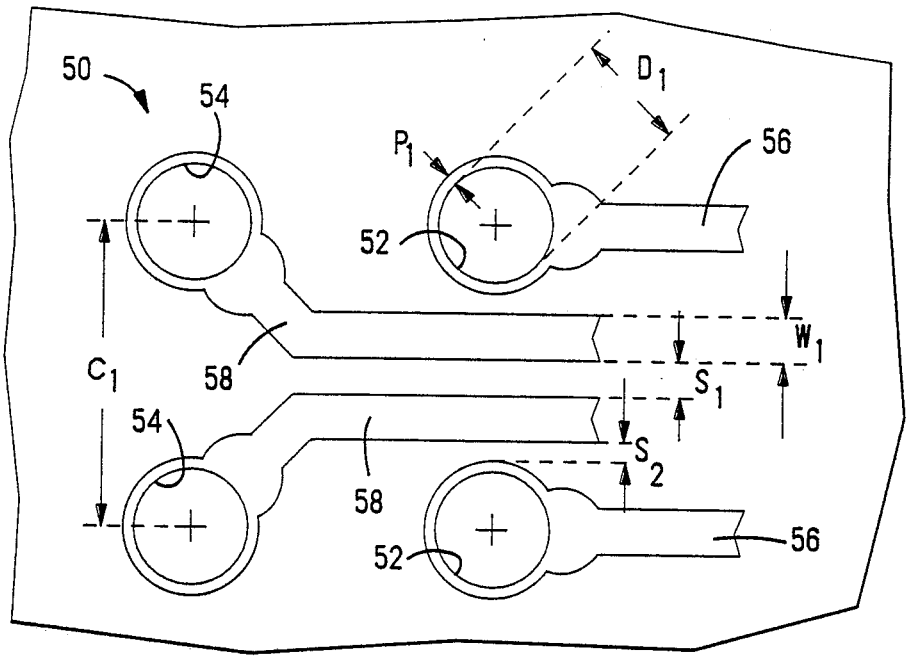
Fig. 8
Fig. 9
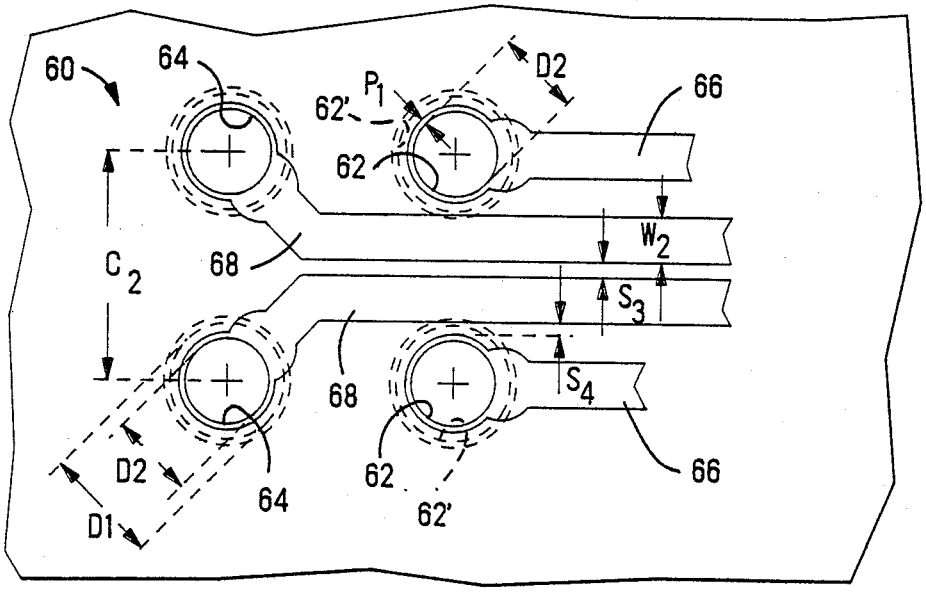

Fig. 10
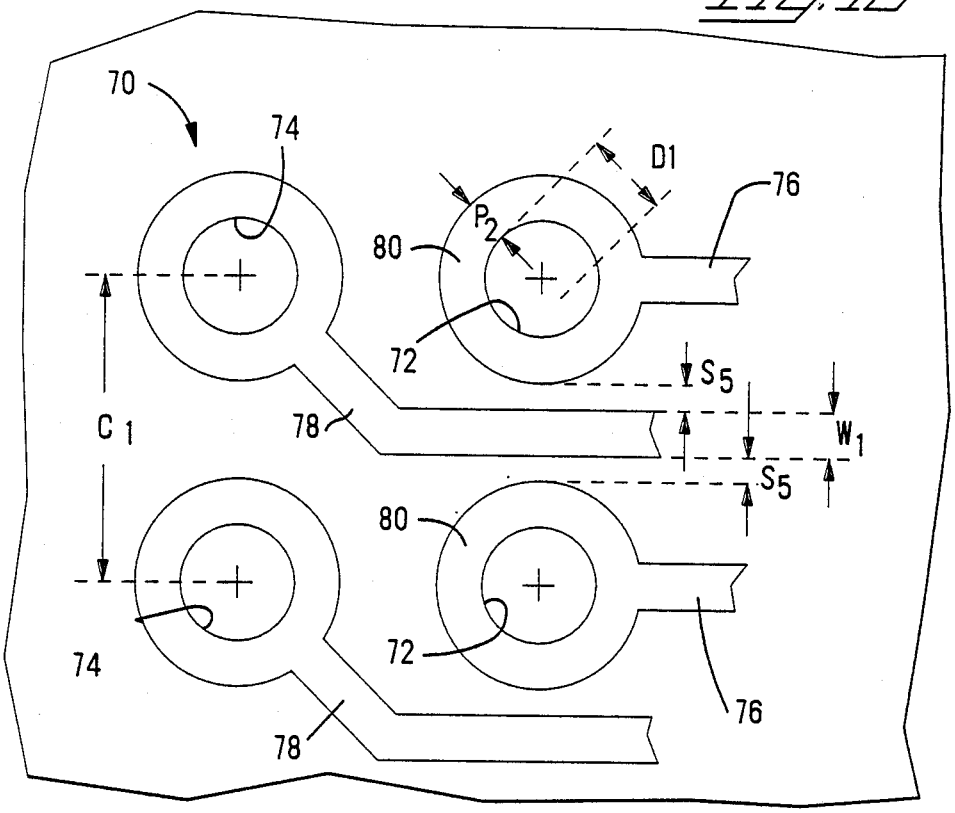
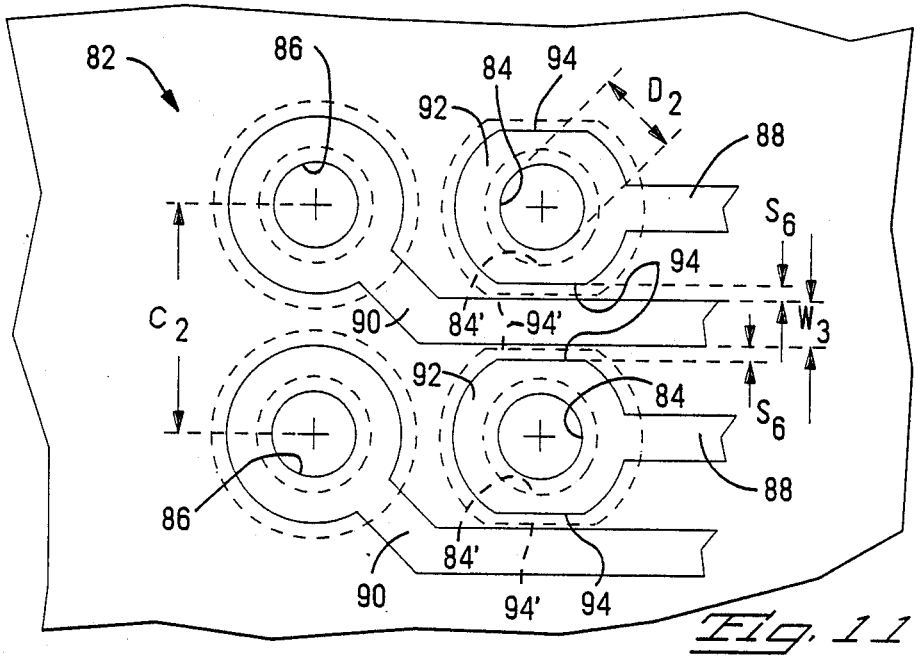
Fig. 11

CONTACT FOR STACKABLE ELECTRICAL CONNECTOR

FIELD OF THE INVENTION

The present invention relates to the field of electrical connectors and more particularly to stackable electrical connectors for interconnecting printed circuit boards of an array.

BACKGROUND OF THE INVENTION

In many applications it is desired to arrange a plurality of printed circuit boards in a parallel array, and to provide a means for interconnecting the conductive traces of each board with associated traces of the adjacent boards by means of electrical connectors, in a manner permitting the boards to be separated and replaced if desired. For convenience it is desired that the interconnected traces be disposed aligned with each other, and the electrical connectors for interconnecting the associated traces thus can be arranged in one stack perpendicular to the boards. Such connectors have arrays of contacts extending perpendicularly with respect to the boards and have post sections extending through plated through-holes of a board for electrical connection to the board's traces while having male contact sections on one side of the board and female contact sections on the other side; thus the contacts of each connector are adapted to mate with corresponding contacts of a matable connector by means of cooperating male and female contact sections. One of the connector housings is a plug which is matably received into the other housing which is a shroud, and the connectors are thus said to be stackable.

One type of stackable connector is sold by AMP Incorporated, Harrisburg, Pa. under Part No. 533650. Also two types of electrical contacts are sold by AMP Incorporated having box-like female contacts matable with square post male contact sections, under Part No. 533667 having a compliant spring section for self-retaining within a plated through-hole of a board, and under Part No. 1-532466-5 having square post sections for wire wrapping by conductor wires.

Traces of many printed circuit boards are generally manufactured to have a width of 0.015 inches, for a certain plated metal thickness to provide certain nominal current-carrying characteristics. Traces must be spaced from each other a minimum distance of 0.005 inches to minimize inductance effects and noise; a trace spacing of 0.010 to 0.012 inches is commonly used to facilitate accuracy during trace plating procedures. Commonly the plated through-holes to which traces extend are arrayed in a closely spaced arrangement for convenience and have a generally accepted nominal hole diameter of 0.038 inches, with the centerlines of the holes being spaced 0.100 inches apart. With a ring of plating material having a width of at least 0.002 inches required peripherally around each plated through-hole, the plated through-holes generally have a maximum spacing between nearest through-hole plating material peripheral edges of at most about 0.058 inches, and the spacing is even less where peripheral conductive pads of 0.015 inches width are used surrounding unplated through-holes for soldering to contacts. In such boards it is required that the traces be spaced a finite small distance from any plating material through or around each hole to avoid short circuiting or bridging especially resulting from eventual soldering operations. In cetain such arrays it is necessary for traces extending to certain holes to pass between holes for others of the traces and be spaced at least the minimum spacing from plating material edges around the holes. Where two traces must pass between adjacent through-holes a minimum distance must be maintained between the two traces and also between each trace and the plating material surrounding each through-hole.

Connectors for such boards have contacts adapted to provide an assured electrical connection to the plating material of the through-holes, and one common type of contact has a square cross-section within the 0.038 inch diameter hole, with dimensions of 0.025 inches by 0.025 inches, establishing a diagonal between opposed corners of about 0.037 inches. The male or post contact section at one end of the contact has continuously therealong the same square cross-section of 0.025 by 0.025 inches, and the female contact section at the other end has a receptacle structure correspondingly adapted to receive a square post of the same dimensions and establish an assured electrical connection therewith by central portions of four elongate arcuate spring arms about 0.016 inches wide engageable with central portions of the flat surfaces along the four sides of the square post. The spring contact arms of the known receptacle contact section are adapted to establish appropriate levels of contact normal force biased against the flat post sides for assured electrical connection, given the 0.025 dimension between the side surfaces of the post.

It is desired among manufacturers of printed circuit boards to reduce the real estate taken up by the through-hole array needed for board interconnection, or to increase the number of through-holes in a given area. Where the holes of conventional diameter of 0.038 inches are moved to have a closer spacing of 0.075 inches, the spacing between conductive material of adjacent through-holes is reduced to 0.033 inches. Where it is desired that the traces continue to maintain their width of 0.015 inches and existing thickness and resultant current-carrying characteristics, the spacing between two traces between adjacent holes and between each trace and the nearby hole becomes unacceptably small, commonly leading to unacceptable inductance effects and noise or else susceptibility to bridging from soldering. Where the 0.038 inch diameter holes are unplated and have 0.015 inch wide conductive peripheral pads or rings therearound for soldering, the distance from an edge of even a single trace to the nearby conductive pad may also become unacceptably small.

It is desired that the contacts of the connectors for interconnecting the boards maintain their square shape and their 0.025 by 0.025 side to side dimensions and meet existing electrical current-carrying requirements, and also mate with the known receptacle contact section having proven reliable mating properties, and to some extent maintain structural strength. Therefore the hole diameter of the board through-holes would seemingly have to be maintained at 0.038 inches to accommodate the post diagonal of about 0.037 inches of such contacts, and rerouting of traces would have to be adopted so that no two traces would have to extend between any adjacent through-holes.

Yet it remains desired to provide a system of interconnecting connectors for 0.075 centerline spacing which permits a pair of traces to extend between adjacent plated through-holes at that spacing, or which permits a single trace to extend between solder pads of adjacent unplated through-holes.

SUMMARY OF THE INVENTION

The present invention provides electrical connectors for interconnecting boards of a parallel array at center-line spacings of 0.075 inches. The contacts of the connectors have a generally square shaped post portion extending through the plated through-holes of a board and comprising the male contact section. The corners of the square post are struck by a die or similar means to assume a smooth, generally rounded shape and still substantially retain the flat side surfaces of the square at least along the central one-half of each side surface in cross-section. It is preferred to maintain as much of the metal from the corners within the cross-section, but alternatively the corners can be machined to such a shape although some metal is thereby removed, for applications where the slight reduction of bulk metal of the cross-section does not lessen the electrical current-carrying capabilities of the contact below the current-carrying requirements for such a contact. As a result, the diagonal of the post is reduced dramatically, enabling smaller diameter through-holes to be formed in the boards, and resulting in more board space to exist between the hole peripheries for a pair of traces to extend therebetween at sufficient distance apart from each other and from the plating material of the holes and eventual solder material thereat.

It is an objective of the present invention to provide contacts for interconnecting a parallel array of boards which enable closer spacing of through-holes which still permits a trace or a pair of traces to extend satisfactorily between adjacent holes.

It is a further objective to reduce the diagonal of square post sections of such contacts without reducing the orthogonal dimensions of the post cross-section through the center, and without removing the flat nature of substantial central portions of the side surfaces, thus enabling smaller diameter through-holes on the board, and without requiring modification of the receptacle contact section matable with the post section.

It is yet a further objective to provide such a contact in an economical manufacturing process.

Embodiments of the present invention will now be described with reference to the accompanying drawings.

BRIEF DESCRIPTION OF THE DRAWINGS

FIG. 8 is a plan view of a portion of a board surface showing several plated through-holes of arrays of the type in FIG. 7A and pairs of traces therebetween;

FIG. 9 is a plan view similar to FIG. 8 but at a smaller hole diameter and closer spacing permitted by the present invention, with the same hole spacing for holes of prior art diameter shown in phantom;

FIG. 10 is a plan view of a portion of a board surface showing several through-holes of arrays of the type in FIG. 7B and a single trace therebetween; and FIG. 11 is a plan view similar to FIG. 10 but at a smaller hole diameter and closer spacing permitted by the present invention, with the same hole spacing for holes of prior art diameter shown in phantom.

DETAILED DESCRIPTION OF THE PRESENT INVENTION

Figure 1:
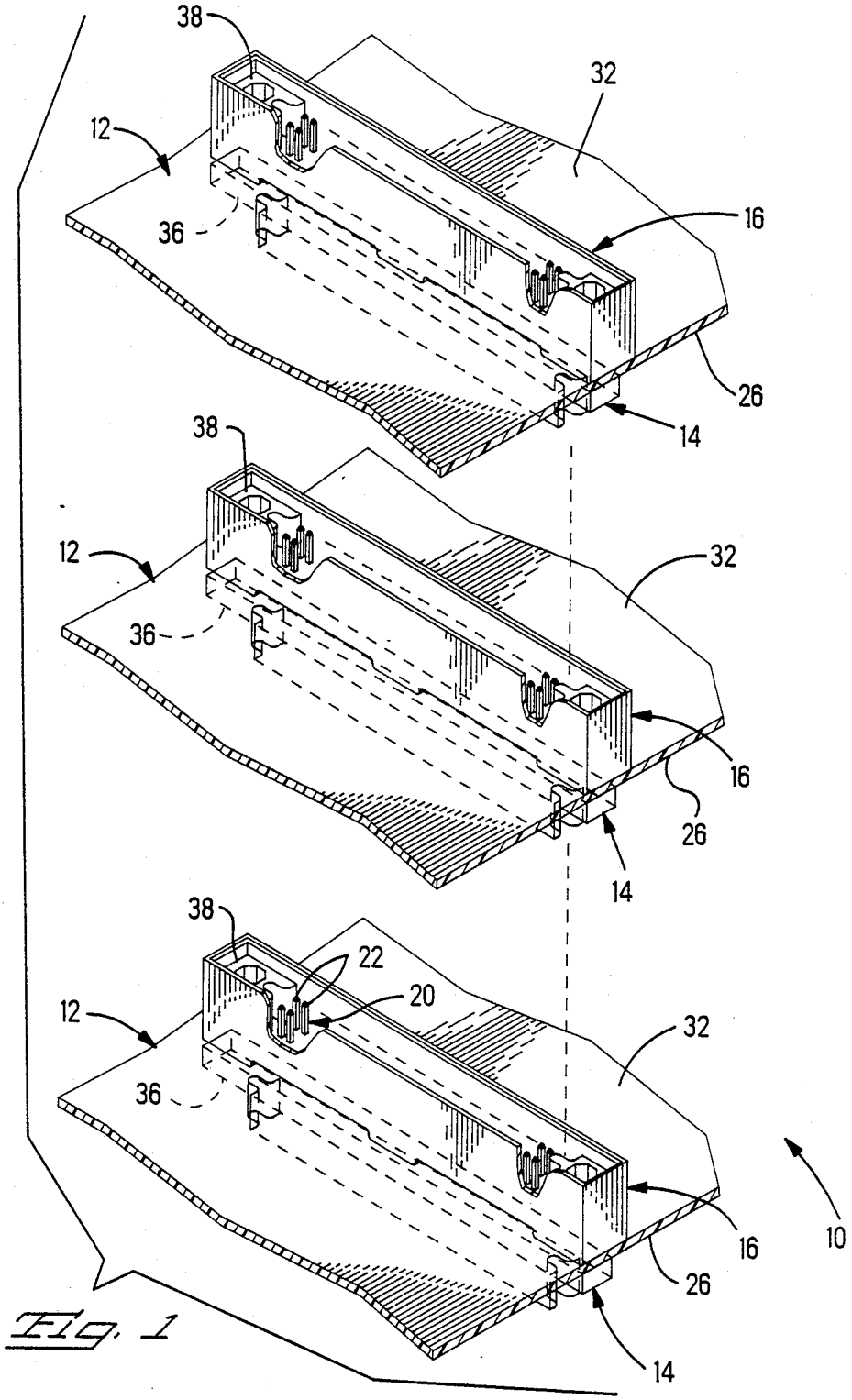
FIG. 1 is an illustration of a parallel board array having stackable connectors interconnecting associated traces thereof.
Figure 2:
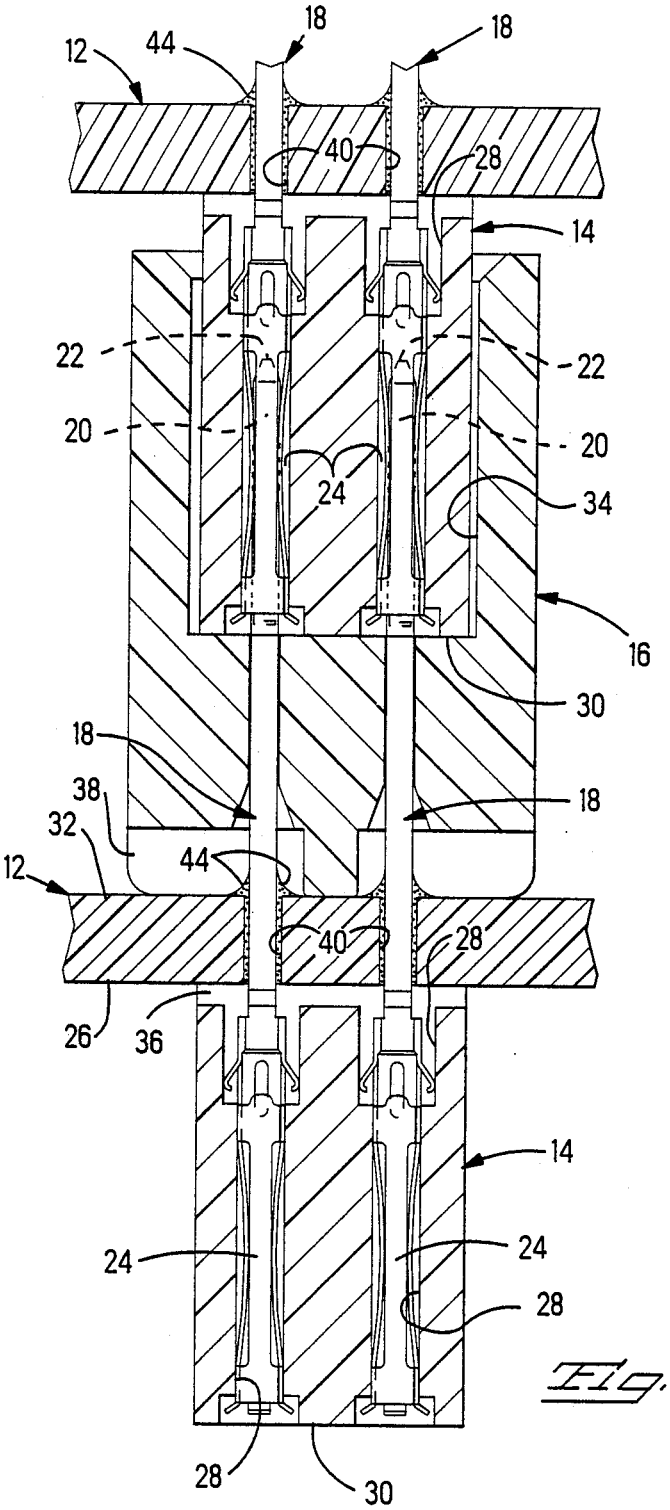
FIG. 2 is a longitudinal section view of a pair of stackable connectors in mated condition, and mounted on respective boards.

FIG. 1 shows a stacked arrangement 10 of several printed circuit boards 12 in parallel orientation and interconnected by plug and receptacle electrical connectors 14,16. FIG. 2 shows in section a pair of stackable connectors 14,16 mounted to respective boards and in mated condition, with contacts 18 secured therein electrically mated. Each contact 18 includes a male square post contact section 20 extending to a leading end 22, and a female box-type receptacle contact section 24 of known manufacture at the other end, with the post contact section 20 of each contact matable with the receptacle contact section 24 of a like contact 18. Each post contact section 20 includes four flat side surfaces engageable by central portions of respective elongate arcuate spring contact arms of the mating receptacle contact section 24 (as shown in cross-section in FIG. 6).

A plug-like connector housing 14 is mounted to one particular side 26 of a board 12 and includes the plurality of receptacle contact sections 24 of contacts 18 disposed along protective passageways 28 of the housing and extending to a mating face 30. A receptacle-like housing 16 also called a shroud is mounted to the other side 32 of the board 12 and defines a large cavity 34 adapted to receive thereinto a plug-like housing 14 mounted to an adjacent board 12. A preferred form of shroud 16 is disclosed in U.S. patent application Ser. No. 07/359,805 filed May 31, 1989 and assigned to the assignee hereof. Post contact sections 20 extend outwardly from the board surface along side 32 in an array within cavity 34 to enter passageways 28 of a mating connector 14 to be matingly received by corresponding receptacle contact sections 24 of corresponding contacts 18. Housings 14,16 preferably include lateral flanges 36,38 including apertures aligned with each other and with board apertures, for mounting screws and key inserts or the like to extend therethrough to mechanically retain the housing pair to opposite sides 26,32 of the board 12. Contacts 18 are stamped and formed from an integral strip of beryllium copper alloy such as UNS No. C17400 or C17200, ¾ hard, having spring properties and skived to have a thickness of about 0.025 inches at the portion to become square posts, and 0.004 inches at the portion to become the receptacle sections. The receptacle section is of known design and is formed into a box-like cross-section and includes spaced annular arrays of lances enabling retention along passageways 28 of housing 14 after insertion thereinto. Contacts 18 are preferably gold-over-nickel plated at least at the surfaces electrically engageable with other contacts and along surfaces to be soldered at respective board through-holes.

Figure 3:
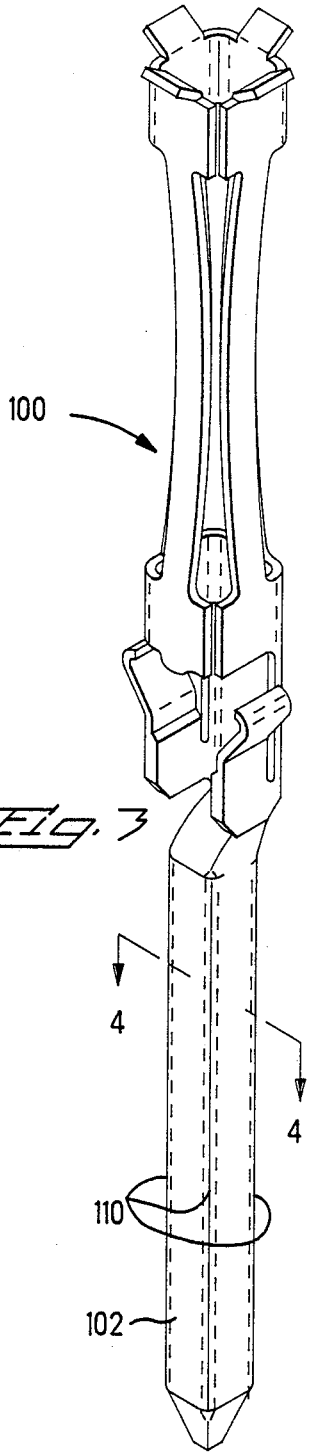
FIG. 3 is a perspective view of a contact of the present invention.
Figure 4:
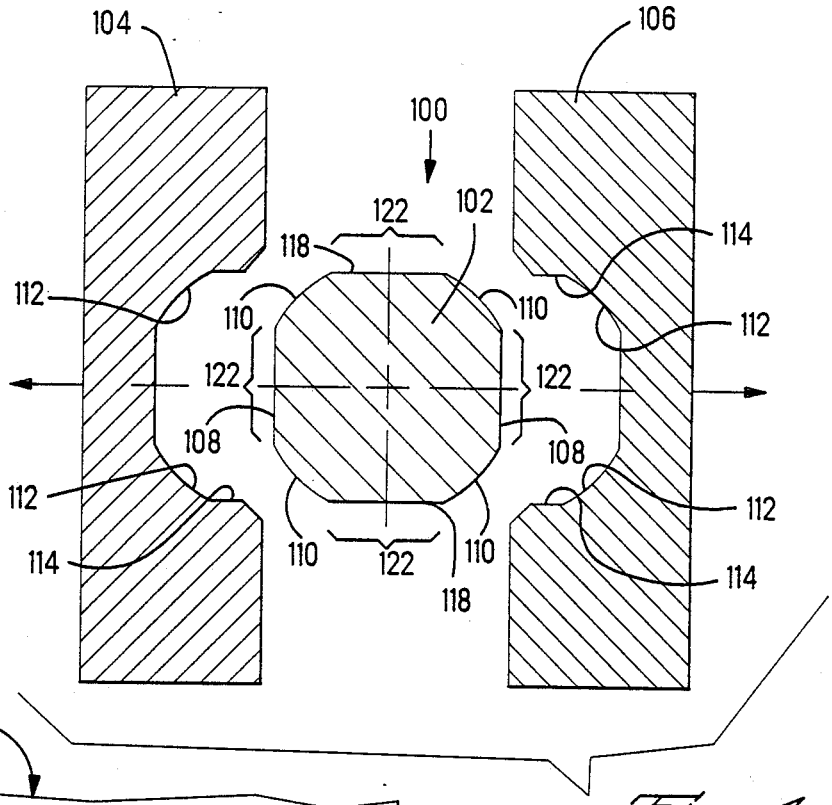
FIG. 4 is an enlarged cross-section along lines 4—4 of FIG. 3 showing the modified square cross-section of the contact of the present invention, with a pair of U-shaped dies useful in performing the modification.

FIGS. 3 and 4 show a contact 100 of the present invention, wherein the corners of the square post 102 are being modified into a smoothly rounded shape by a pair of dies 104,106 of appropriate shape striking the post from opposing sides 108, and can be performed for example during the process of stamping the contacts from the metal strip. Optionally a sequence of die strikes may be used. Rounded corners 110 are formed by corresponding die corners 112 each of which has a radius of 0.014 inches to form an arc matching that of a hole wall of 0.028 inch diameter, reducing the diagonal of the cross-section significantly. The metal originally at the corners tends to form local regions of increased density adjacent the corners especially if completely confined by wall portions 114 of dies 104,106 spaced apart at 0.025 inches. Sharp burs if formed could be removed by conventional deburring techniques. After such processing steps the contact may be appropriately plated. It is also optional to form a non-square cross-section initially, with a slightly elongate width (such as 0.026 inches) between sides 108,108 which will be struck by appropriately shaped die surfaces to move metal laterally to increase a slightly lesser width (such as 0.023 inches) between sides 118,118, resulting in smoothly rounded corners 110 and flat sides 108,108 and 118,118 and orthogonal dimensions therebetween of 0.025 by 0.025 inches through the center after all the forming and corner modifying steps are performed, and a longest diagonal of about 0.028 inches defining an effective post diameter.

Figure 5:
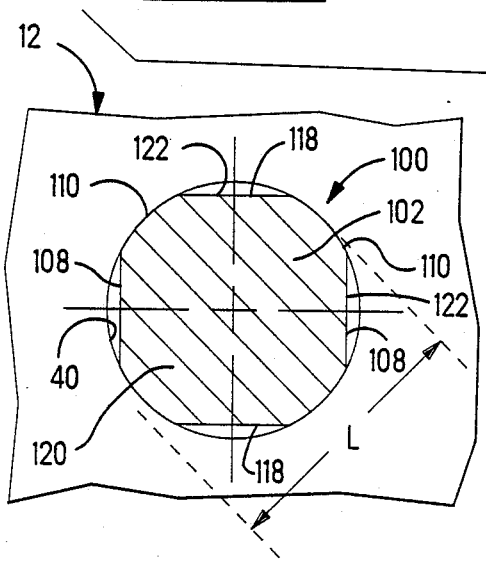
FIG. 5 is an enlarged cross-section similar to that of FIG. 4 showing the modified post section disposed within a board through-hole.

Referring to FIG. 5 body section 120 of post contact section 102 is disposed within a through-hole 40 of a board 12, with outwardmost extending portions of smoothly rounded corners 110 closely adjacent wall surfaces of the hole which define the longest diagonal having a dimension L.

Figure 6:
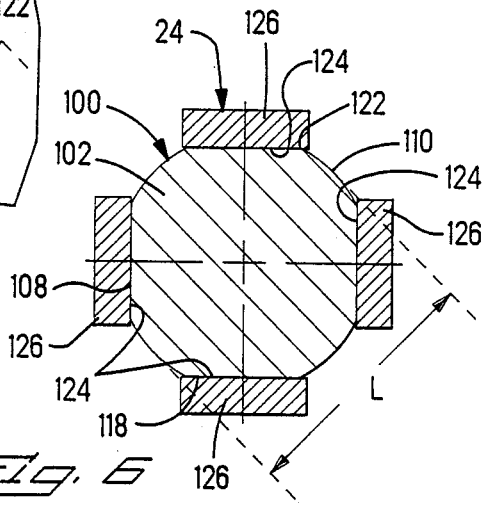
FIG. 6 is an enlarged cross-section similar to that of FIG. 4 showing the modified post contact section in mated engagement with the spring contact arms of a mating receptacle contact section.

Referring to FIG. 6 it is seen that central portions 122 are retained as flat sides for engagement by inwardly facing contact surfaces 124 of spring contact arms 126 of a receptacle contact section 24 seen in FIG. 2. For example, in AMP Incorporated Part No. 533667 the width of the contact surfaces 124 of spring contact arms 126 of the receptacle contact section, is about 0.016 inches, for mating with side surfaces of a square post section 20 having dimensions of 0.025 by 0.025 inches. Thus only the central 0.016 to 0.018 inches of side surfaces of the square post 20 are utilized for electrical engagement. Central portion 122 can remain flat for a distance of 0.013 inches. The diagonal can be reduced to 0.028 inches from 0.037 inches.

A contact of the present invention could also be formed by abrading the relocated metal if outward bulges occur along the non-stamped sides, to provide totally flat post sides, to minimize the possibility of affecting the engagement of the spring contact arms sections of the receptacle contact with the flat post sides of the post contact section upon mating and to minimize interfering with placement into the board through-hole. Alternatively, the metal at the corners of the square post could be removed by abrasion along both the post contact section and the body section, instead of forming the rounded corners with dies as in FIG. 3, such reduction of the metal content of the cross-section through the body section as well as the post contact section would reduce the current carrying capability and therefore more closely approach the current-carrying requirements of a contact if a 0.025 by 0.025 inch square post has a current-carrying capability significantly exceeding current-carrying requirements of such contact; but still it is believed that such an abraded contact could attain some of the benefits of the present invention of permitting closer through-hole placement on the board.

Figure 7A:
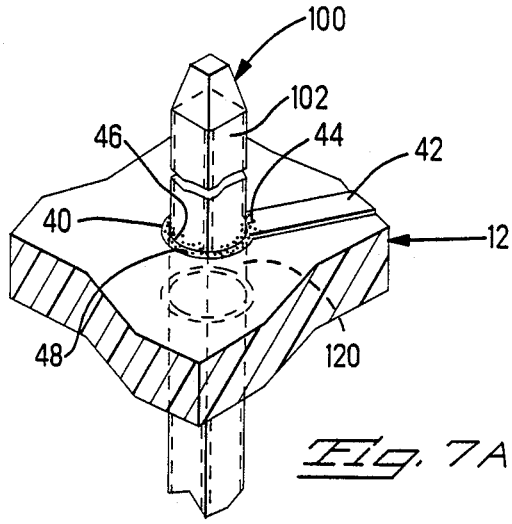
FIGS. 7A and 7B are enlarged views of a square post section of a contact being inserted into a plated through-hole of a board, and into an unplated through-hole having a wide peripheral conductive pad therearound for soldering, respectively.

In FIG. 7A each post contact section 102 of a representative contact 100 extends from a square body section 120 of the same cross-section, with body section 120 extending through a plated through-hole 40 of a board 12 for electrical connection with a corresponding conductive trace 42 of the board, by being joined by solder fillet 44 to plating material along inside surfaces 46 of the plated through-hole 40 and to narrow peripheral ring 48 therearound, for an assured electrical connection therewith. Alternatively, in FIG. 7B an unplated through-hole 40' of a board 12' may have a peripheral pad 48' of plating material therearound by which solder electrically joins the contact 100' to the associated board trace 42' at fillet 44'.

FIG. 8 is based on FIG. 7A and shows an interconnection array 50 of several plated through-holes 52,54 with their centerlines spaced apart at distances $C_1$ which conventionally are 0.100 inches, with a pair of traces 56,56 extending from holes 52 and a pair of traces 58,58 extending from holes 54 and between holes 52 and traces 56,56. Holes 52,54 have nominal diameters $D_1$ conventionally of 0.038 inches, peripheral pads therearound have nominal widths $P_1$ of 0.002 inches, and traces 56,58 have nominal widths $W_1$ of 0.015 inches and are spaced from adjacent traces at least 0.010 inches at $S_1$. In addition traces 58,58 are spaced at $S_2$ at least 0.005 inches from peripheries of holes 52. The total dielectric spacing $S_1+S_2+S_2$ at the region between holes 52 through which traces 58,58 must pass is thus a minimum of 0.020 inches, which fits within the available dielectric distance between peripheral edges of $C_1-D_1-P_1-P_1-W_1-W_1$, which is 0.028 inches.

With the contact of the present invention, the array of FIG. 8 could be spaced at closer hole centerlines as seen in FIG. 9. The diameters $D_2$ of holes 62,64 of array 60 may now be 0.025 inches and spaced at centerline spacings $C_2$, and the width $W_2$ of traces 66,68 reduced only incrementally to 0.014 inches. Alternatively each peripheral ring may be reduced to 0.001 inches nearest a trace edge, or the dielectric spacing $S_4$ can be reduced to 0.004 inches to accommodate the slight congestion. If the spacing $S_3$ between the pair of traces is reduced to the requisite minimum of 0.005 inches between holes 62, the total dielectric spacing $S_3+S_4+S_4$ is thus the minimum of 0.015 inches, equal to the available dielectric spacing of $C_2-D_2-P_1-P_1-W_2-W_2$ of 0.015 inches. If hole spacing $C_1$ of FIG. 8 were simply reduced to 0.075 inches, with holes 62' having prior art diameter $D_1$ and relative trace positioning remaining substantially unmodified, as illustrated in phantom in FIG. 9, the width W of traces 68' and spacings $S_1$ and $S_2$ must be reduced drastically below acceptable minimum amounts in order to fit within the total available dielectric spacing at the region between holes 62' through which the pair of traces 68,68 must pass, which would be reduced to an unacceptable 0.005 inches and forbidding routing a pair of traces therebetween.

Figure 7B:
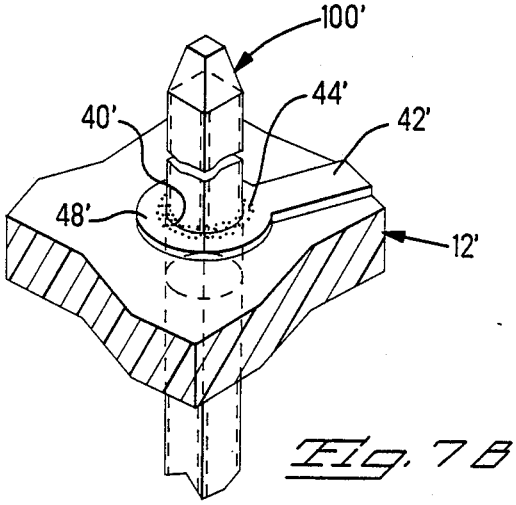

FIG. 10 is based on FIG. 7B and shows an interconnection array 70 of several through-holes 72,74 with centerlines spaced apart at distances $C_1$ which conventionally are 0.100 inches. Peripherally around each through-hole 72,74 is a ring 80 of plating material for soldering having a width $P_2$ of 0.015 inches. A trace 76 extends from each hole 72 and a trace 78 extends from each hole 74, with each trace extending between each adjacent pair of holes 72. Holes 72,74 have nominal diameters $D_1$ of 0.038 inches, traces 76,78 have nominal widths $W_1$ of 0.015 inches, and the edges of each trace 78 are spaced at $S_5$ about 0.0085 inches from the outer edge of peripheral rings 80 of holes 72. The total dielectric spacing $S_5+S_5$ at the region between holes 72 through which trace 78 must pass is thus 0.017 inches.

With the contact of the present invention, the array of FIG. 10 could be spaced at closer hole centerlines as seen in FIG. 11. The diameters $D_2$ of holes 84,86 of array 82 to which traces 88,90 extend may now be 0.028 inches and spaced at centerline spacings $C_2$, and if the width of peripheral rings 92 is lessened by defining chordal edges 94 along the portions beside traces 90 to a dimension of 0.011 from the hole, the width $W_3$ of traces 90 may be kept the same as $W_1$ of 0.015 inches. The total dielectric spacing $S_6+S_6$ is thus maintained a satisfactory 0.010 inches. If hole spacing $C_2$ of FIG. 10 were simply reduced to 0.075 inches, with hole diameter $D_1$ remaining at 0.038 inches and peripheral ring width $P_2$ reduced near trace 90 to a minimum of 0.011 inches at chordal edges 94', as shown in phantom in FIG. 11, the width of a trace 90 and spacings $S_5$ must somehow be reduced to unacceptably small dimensions, since the total available dielectric spacing at the region between rings 92' around holes 84' through which trace 90' must pass is reduced to 0.015 inches.

Other modifications and variations may be made to the present embodiment which are within the spirit of the invention and the scope of the claims.

What is claimed is:

1. An electrical contact for use with printed circuit boards, being of the type having a square post section insertable through a through-hole of the board and electrically connectable to a respective board circuit path thereat and having at least one contact section to be disposed spaced from the board after full insertion through the board through-hole for electrical connection with a corresponding contact means for another electrical article comprising:

a metal member including at least at one end thereof a post section defining four orthogonal flat side surfaces, said post section having a generally rectangular cross-section wherein the opposing pairs of sides thereof are first and second distances apart, and corners of said post section are smoothly rounded thereby reducing the diagonal of said cross-section and permitting insertion through a board through-hole having a diameter substantially less than the length of the hypoteneuse of a right-angle triangle having sides adjacent the right angle equal to said first and second distances, while maintaining unrounded substantial portions of said four orthogonal flat side surfaces for engagement by respective flat contact surfaces of spring contact arms of a corresponding receptacle contact section of a contact means of said another electrical article.

2. An electrical contact as set forth in claim 1 wherein said rounded corners are formed by being stamped by die means of tooling whereby metal from said corners remains within the cross-section, and the dimensions between said side surfaces at least after said stamping are appropriate for said side surfaces to be matingly engaged by spring contact arm portions of said corresponding receptacle contact section matable with a square post having said dimensions.

3. An electrical contact as set forth in claim 1 wherein said rounded corners are abraded.

4. An electrical contact as set forth in claim 1 wherein an end of said metal member includes thereon a receptacle contact section matable with a post section of another like contact, thereby defining a contact usable in a stackable electrical connector for interconnecting printed circuit boards in a parallel array.

* * * * *